US009238156B2

(12) United States Patent
Apel et al.

(10) Patent No.: US 9,238,156 B2
(45) Date of Patent: Jan. 19, 2016

(54) PERSONAL FALL LIMITER ARRANGEMENT AND USER CONNECTION ARRANGEMENT THEREFOR

(75) Inventors: Robert A. Apel, Cranberry Twp., PA (US); Jeffrey Wu, Jiangsu (CN); James Zhan, Jiangsu (CN)

(73) Assignee: MSA Technology, LLC, Cranberry Township, PA (US)

( * ) Notice: Subject to any disclaimer, the term of this patent is extended or adjusted under 35 U.S.C. 154(b) by 302 days.

(21) Appl. No.: 13/223,524

(22) Filed: Sep. 1, 2011

(65) Prior Publication Data

US 2013/0015017 A1 Jan. 17, 2013

Related U.S. Application Data

(60) Provisional application No. 61/506,368, filed on Jul. 11, 2011.

(51) Int. Cl.
*A62B 35/00* (2006.01)

(52) U.S. Cl.
CPC ..... *A62B 35/0075* (2013.01); *A62B 35/0037* (2013.01)

(58) Field of Classification Search
CPC ..... A62B 35/0037; A62B 35/0075; A62B 35/0093; A44B 11/253
USPC ..... 182/3; 24/459, 499, 500, 634
See application file for complete search history.

(56) References Cited

U.S. PATENT DOCUMENTS

| | | | | |
|---|---|---|---|---|
| 1,209,369 | A * | 12/1916 | Wood | 24/648 |
| 3,713,192 | A * | 1/1973 | Wallin | 24/645 |
| 6,073,724 | A * | 6/2000 | Wolner et al. | 182/3 |
| 6,668,434 | B2 * | 12/2003 | Casebolt et al. | 24/634 |
| 6,965,231 | B1 * | 11/2005 | Cinoglu et al. | 324/300 |
| 7,073,627 | B2 * | 7/2006 | Casebolt et al. | 182/3 |
| 7,114,225 | B2 * | 10/2006 | Casebolt et al. | 24/634 |
| 7,178,632 | B2 * | 2/2007 | Casebolt et al. | 182/3 |
| 7,350,277 | B1 * | 4/2008 | Canfield et al. | 24/634 |
| 7,373,701 | B2 * | 5/2008 | Coulombe et al. | 24/648 |
| 8,181,319 | B2 * | 5/2012 | Johnson et al. | 24/648 |
| 2007/0151805 | A1 | 7/2007 | Betcher et al. | |
| 2009/0211849 | A1 * | 8/2009 | Smith et al. | 182/231 |

FOREIGN PATENT DOCUMENTS

| | | | |
|---|---|---|---|
| CA | 2480613 | A1 | 3/2006 |
| CN | 201026354 | Y | 2/2008 |
| CN | 201823186 | U | 5/2011 |

* cited by examiner

*Primary Examiner* — Colleen M Chavchavadze
(74) *Attorney, Agent, or Firm* — The Webb Law Firm

(57) ABSTRACT

A personal fall limiter arrangement having a user connection arrangement, including: a body attached to at least a portion of the frame and having a recess configured to receive at least a portion of a user connector; at least one tab pivotally attached to a first portion of the body; and at least one biasing member engaged with the at least one tab and configured to urge the at least one tab towards a locked (or closed) position; wherein, in operation, the at least one tab is pivotal between: (1) an open position to permit passage of at least a portion of the user connector into or out of the recess; and (2) the locked position to prevent passage of at least a portion of the user connector out of the recess.

19 Claims, 8 Drawing Sheets

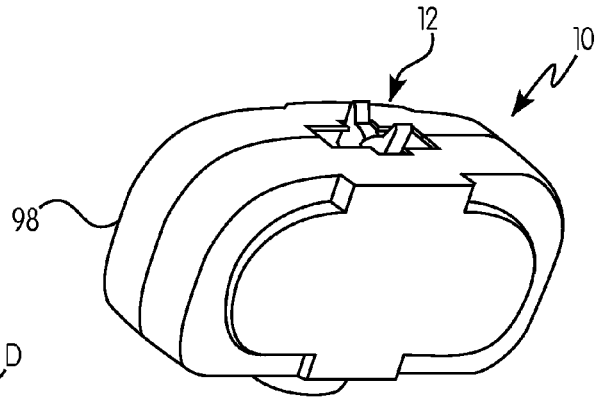
FIG. 10
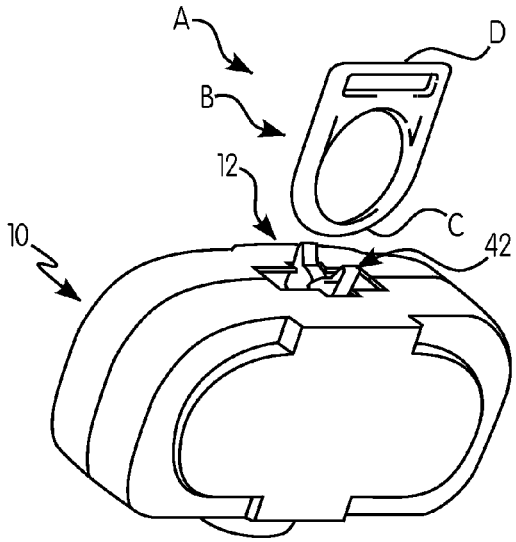
(a)
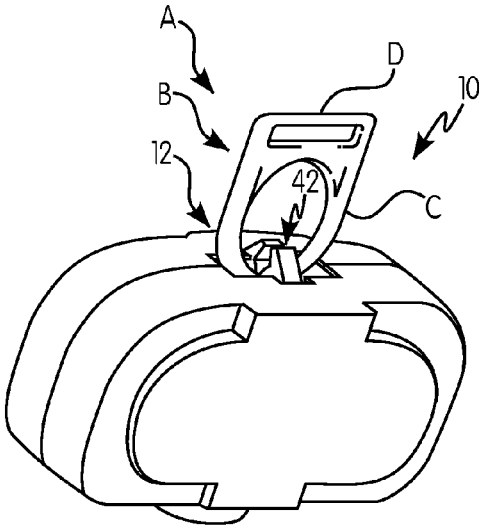
(b)
FIG. 11
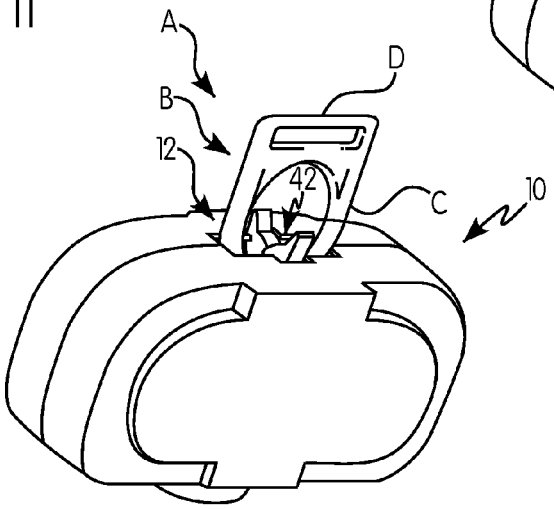
(c)

PERSONAL FALL LIMITER ARRANGEMENT AND USER CONNECTION ARRANGEMENT THEREFOR

CROSS REFERENCE TO RELATED APPLICATIONS

This application claims the benefit of priority from Provisional Patent Application No. 61/506,368, filed Jul. 11, 2011, the contents of which are incorporated herein in its entirety.

BACKGROUND OF THE INVENTION

1. Field of the Invention

The present invention relates generally to fall protection systems and arrangements for ensuring the safety of users during and after a fall event, and in particular to a personal fall limiter arrangement and user connection arrangement therefore for use in conjunction with other safety equipment.

2. Description of the Related Art

As is known in the art, a variety of activities, workplace functions, and emergency situations require additional safety measures and systems. In particular, such activities, functions, and situations include, without limitation, climbing, construction, and rescue situations. In order to provide safety to the person involved in the activity, function, and situation, certain safety equipment is utilized. For example, a person often wears a full body harness or safety belt that is removably attachable and is formed using one or more lengths of straps. As also is known, such harnesses or belts include a connector attached thereto, such as a D-ring or the like. It is this D-ring or connector that is attached to other safety equipment and arrangements, such as a personal fall limiter.

A personal fall limiter arrangement, such as a self-retracting lanyard, normally includes a hub rotatably attached to a frame, and a braking assembly operable to brake the rotation of the hub. A line, such as a synthetic strap or cable, is attached to and wound around the hub. The free end of the line is formed with a loop to which some connector is attachable. This connector may be, for example, a snap-hook, a carabiner, or the like. This connector is then attached to some secure point on a structure or other secure area. While not necessary, such arrangements may also include one or more springs that continually urge the line back around the hub to remove any slack in the line.

Further, the personal fall limiter arrangement includes or is attached either directly to the strap of the harness or belt, or more often, to the user connector, e.g., the D-ring. In this manner, the personal fall limiter arrangement is securely connected between the user's harness or belt and some secure point. Accordingly, in the event of a fall, the line will pay out of the arrangement, and the braking assembly will safely brake the line so as to relieve or minimize the forces of the fall event on the user. As is known, such a brake assembly may include a pawl-and-sperrad arrangement, or some other structural interrelationships to effectively slow the pay out of the line and protect the user.

One example of a known personal fall limiter arrangement is the "Safety Retractable Lanyard" of Ultra-Safe Inc. This arrangement includes a removably attachable connector in the form of a clip that can be threaded open and closed around the D-ring. However, this connector is long and, therefore, in a fall event may move and strike the user's back, neck, or head. In addition, this connector includes multiple connection points and, therefore, multiple possible failure points.

Other personal fall limiter arrangements include integrated user connection arrangements that utilize complicated mechanical structures. Such connection arrangements may also be attached directly to the harness or belt (i.e., not to a separate D-ring). However, the use of such complicated mechanical structures also lead to many failure points and other mechanical failures. Still further, the operation of such mechanical structures is not intuitive, and may even lead to partial closing of the connection points (yet another source of safety concerns with such arrangements). One example of such an arrangement is the self-retracting lifeline shown in U.S. Patent Publication No. US 2007/0151805.

Accordingly, there remains a need in the art for improved personal fall limiter arrangements that provide enhanced safety to the user. Further, there is a need in the art for improved user connection arrangements that safely attach a personal fall limiter arrangement, or other similar device, to the harness or belt of the user.

SUMMARY OF THE INVENTION

Accordingly, the present invention provides a personal fall limiter arrangement and user connection arrangement therefore that address or overcome certain drawbacks and deficiencies existing in known personal fall limiter arrangements. Generally, the present invention provides a personal fall limiter arrangement and user connection arrangement therefore that provide quick and effective attachment directly or indirectly to a user's harness or belt. Preferably, the present invention provides a personal fall limiter arrangement and user connection arrangement therefore that provide an intuitive, yet secure, structure to attach and detach the personal fall limiter arrangement to the user's harness or belt. Preferably, the present invention provides a personal fall limiter arrangement and user connection arrangement therefore that lead to improved user safety.

In one preferred and non-limiting embodiment, provided is a personal fall limiter arrangement, including: at least one hub rotatably attached to a frame; at least one braking assembly configured to brake rotation of the at least one hub; at least one line having a first end and a second end, the first end attached to a portion of the at least one hub, and the second end configured for attachment to a connector; and a user connection arrangement. The user connection arrangement includes: (i) a body attached to at least a portion of the frame and having a recess configured to receive at least a portion of a user connector; (ii) at least one tab pivotally attached to a first portion of the body; and (iii) at least one biasing member engaged with the at least one tab and configured to urge the at least one tab towards a locked (or closed) position. In operation, the at least one tab is pivotal between: (1) an open position to permit or facilitate passage of at least a portion of the user connector into or out of the recess; and (2) the locked position to prevent passage of at least a portion of the user connector out of the recess.

In a further preferred and non-limiting embodiment, provided is a personal fall limiter arrangement, including: at least one hub rotatably attached to a frame; at least one braking assembly configured to brake rotation of the at least one hub; at least one line having a first end and a second end, the first end attached to a portion of the at least one hub, and the second end configured for attachment to a connector; and a user connection arrangement. The user connection arrangement includes: (i) a body rigidly attached to at least a portion of the frame and having a recess configured to receive at least a portion of a user connector; (ii) a first tab pivotally attached to a first portion of the body; (iii) at least one first biasing member engaged with the first tab and configured to urge the first tab in a first direction towards a locked (or closed) position; (iv) a second tab pivotally attached to a second portion of the body in a mutually opposed position with respect to the first tab; and (v) at least one second biasing member engaged with the second tab and configured to urge the second tab towards a locked (or closed) position. In operation, the first tab and the second tab are pivotal between: (1) an open position to permit passage of at least a portion of the user connector into or out of the recess; and (2) the locked position to prevent passage of at least a portion of the user connector out of the recess.

In another preferred and non-limiting embodiment, provided is a user connection arrangement, including: a body having a recess configured to receive at least a portion of a user connector; at least one tab pivotally attached to a first portion of the body; and at least one biasing member engaged with the at least one tab and configured to urge the at least one tab in a first direction towards a locked (or closed) position. In operation, the at least one tab is pivotal between: (1) an open position to permit passage of at least a portion of the user connector into or out of the recess; and (2) the locked position to prevent passage of at least a portion of the user connector out of the recess.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which than a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 4(*b*) is a side view of the user connection arrangement of FIG. 4(*a*);

FIG. 4(*c*) is an edge view of the user connection arrangement of FIG. 4(*a*);

FIG. 4(*d*) is a perspective view of the user connection arrangement of FIG. 4(*a*);

FIG. 4(*e*) is a cross sectional view along line A-A of the user connection arrangement of FIG. 4(*a*);

FIG. 5(*b*) is a cross sectional view along line A-A of the user connection arrangement of FIG. 5(*a*);

FIG. 5(*c*) is a cross sectional view along line B-B of the user connection arrangement of FIG. 5(*a*);

FIG. 5(*d*) is a perspective view of the user connection arrangement of FIG. 5(*a*);

FIG. 6(*b*) is an edge view of the user connection arrangement of FIG. 6(*a*);

FIG. 6(*c*) is a perspective view of the user connection arrangement of FIG. 6(*a*);

FIG. 6(*d*) is a cross sectional view along line A-A of the user connection arrangement of FIG. 6(*a*);

FIG. 7(*b*) is a side view of the user connection arrangement of FIG. 7(*a*);

FIG. 7(*c*) is an edge view of the user connection arrangement of FIG. 7(*a*);

FIG. 7(*d*) is a perspective view of the user connection arrangement of FIG. 7(*a*);

FIG. 7(*e*) is a cross sectional view along line A-A of the user connection arrangement of FIG. 7(*b*);

FIG. 10 is a perspective view of a further embodiment of a personal fall limiter arrangement according to the principles of the present invention; and FIGS. 11(*a*)-(*c*) are perspective views of the attachment of a user connector to the personal fall limiter arrangement according to the principles of the present invention.

DETAILED DESCRIPTION OF THE PREFERRED EMBODIMENTS

Figure 2:
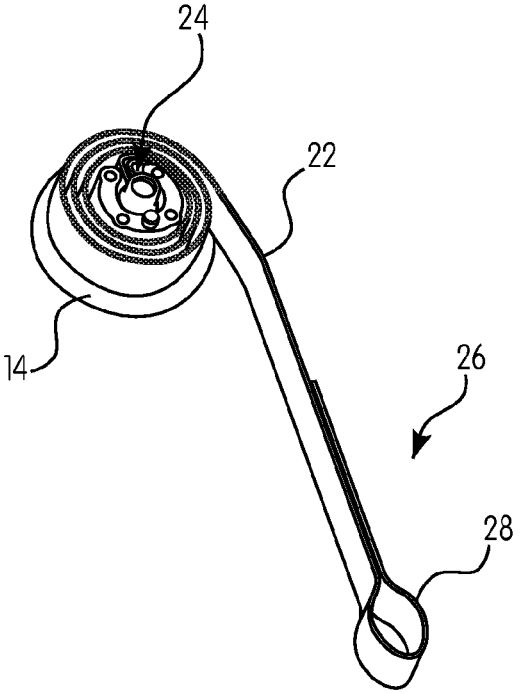
FIG. 2 is a side view of a hub and line arrangement for use in connection with a personal fall limiter arrangement according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a personal fall limiter arrangement 10 and a user connection arrangement 12 for use in a variety of activities, as discussed above. While, in one preferred and non-limiting embodiment, the personal fall limiter arrangement 10 is in the form of a self-retracting lanyard, any similar safety line arrangement can be utilized within the scope and context of the present invention. Further, the user connection arrangement 12 provides a unique structural and operational arrangement and assembly for connection of a user connector A. For example, as seen in FIG. 11, this user connector A may be in the form of a D-ring connector B or similar component.

Further, the presently-invented personal fall limiter arrangement 10 and user connection arrangement 12 are configured for direct or indirect attachment to a user, such as a construction worker or the like. Normally, the personal fall limiter arrangement 10 (and/or user connection arrangement 12) would be attached to the above-mentioned user connector A (e.g., a D-ring connector B), which is attached to a portion of a harness assembly (not shown) worn by the user. The use of such a D-ring connector B for attachment of a personal fall limiter arrangement, such as the personal fall limiter arrangement 10 of the present invention, to a harness is well known in the art. Accordingly, the harness, which may be a belt, a full body harness, a sling, a rope, a suit, or other arrangement or equipment worn by the user, will not be discussed in any further detail. Still further, the user connector A may be replaced with another connection or attachment arrangement, such as a connector that facilitates attachment to a secure point or rigid structure.

Figure 1:
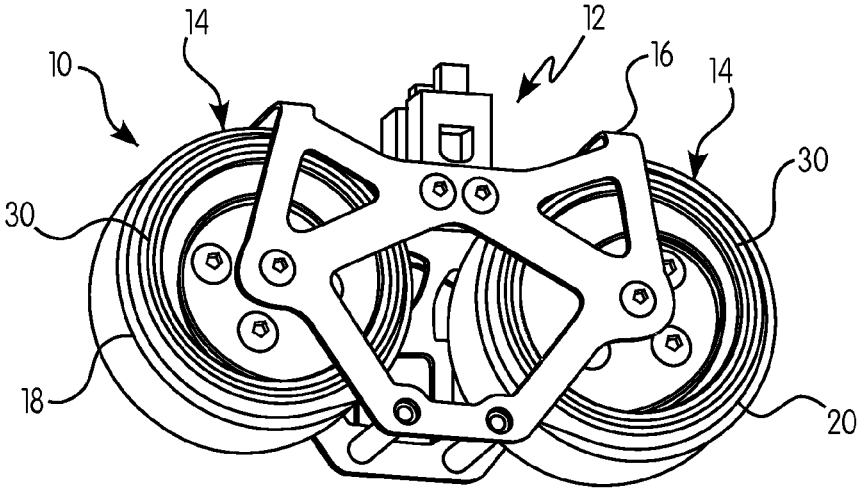
FIG. 1 is a perspective view of one embodiment of a personal fall limiter arrangement according to the principles of the present invention.

As illustrated in one preferred and non-limiting embodiment in FIG. 1, the personal fall limiter arrangement 10 includes a hub 14 rotatably attached to a frame 16. Accordingly, this hub 14 spins about a central axis, and thus, is centrally attached to a portion of the frame 16 by any known means. In the embodiment of FIG. 1, a first hub 18 and a second hub 20 are both rotatably attached to different portions of the frame 16. As a result, the personal fall limiter arrangement 10 can be used in connection with two different secure points. Of course, in such an arrangement, it is envisioned that the user connector A is a clip, connector, e.g., a D-ring connector B, an attachment mechanism, or some other arrangement that can be attached between the personal fall limiter arrangement 10 and either the user and/or a secure point. Regardless, and as discussed hereinafter, the first hub 18 and the second hub 20 operate in a substantially similar manner and will not be discussed separately hereinafter.

As illustrated in FIG. 2, a safety line 22 is provided and includes a first end 24 and a second end 26. The first end 24 of the line 22 is attached to a portion of the hub 14, and the second end 26 of the line 22 is configured or arranged for attachment to another connector (not shown). For example, the second end 26 of the line 22 may be in the form of a loop 28 that allows for the attachment (either permanent or removable) of this other connector, which may be in the form of a carabiner, a clip, a snap-hook, or some other attachment arrangement or mechanism.

As also illustrated in FIG. 2, a power spring 30 is functionally attached to the hub 14 and configured to urge the hub 14 in a specific direction. This "urging" feature causes the hub 14 to continually urge or retract the line 22 back around a portion of the hub 14. This is known as a "self-retracting" function. Further, this line 22 may take a variety of forms. For example, the line 22 may be in the form of a cable, a webbing material, a rope, or any other elongate member. However, as discussed above, one preferred and non-limiting embodiment includes a line 22 that is continually urged in a direction to be wound around the hub 14, i.e., retract.

Figure 3:
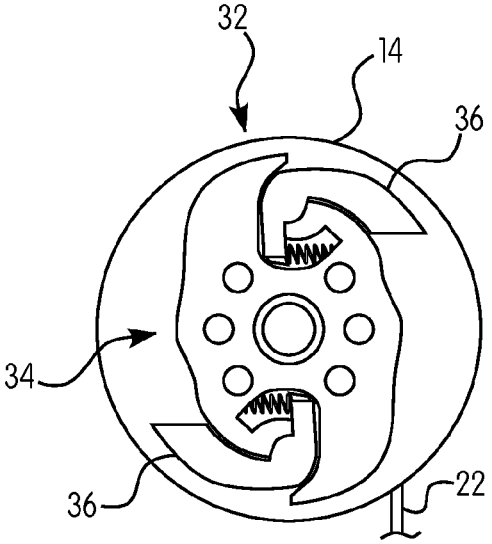
FIG. 3 is a side view of a braking assembly for use in connection with a personal fall limiter arrangement according to the principles of the present invention.

With reference to FIG. 3, the personal fall limiter arrangement 10 of the present invention includes a braking assembly 32 in order to brake rotation of the hub 14. In this embodiment, the braking assembly 32 is in the form of a known pawl-and-sperrad arrangement 34. While only the pawls 36 are illustrated in FIG. 3, it is generally known how these pawls 36 are used in connection with or functionally interrelated with a sperrad (or other root area) that is rigidly connected to the frame 16 in order to achieve the braking function. However, it is to be understood that any known braking assembly 32 and arrangement can be used to prevent, slow, or stop rotation of the hub 14, which prevents continued removal of the line 22 from around the hub 14. Further, this braking assembly 32 may include or be integrated with a variety of assemblies and mechanisms that prevent the sudden or immediate cessation of hub rotation, and/or prevent any "rebound" effect.

Figure 4:
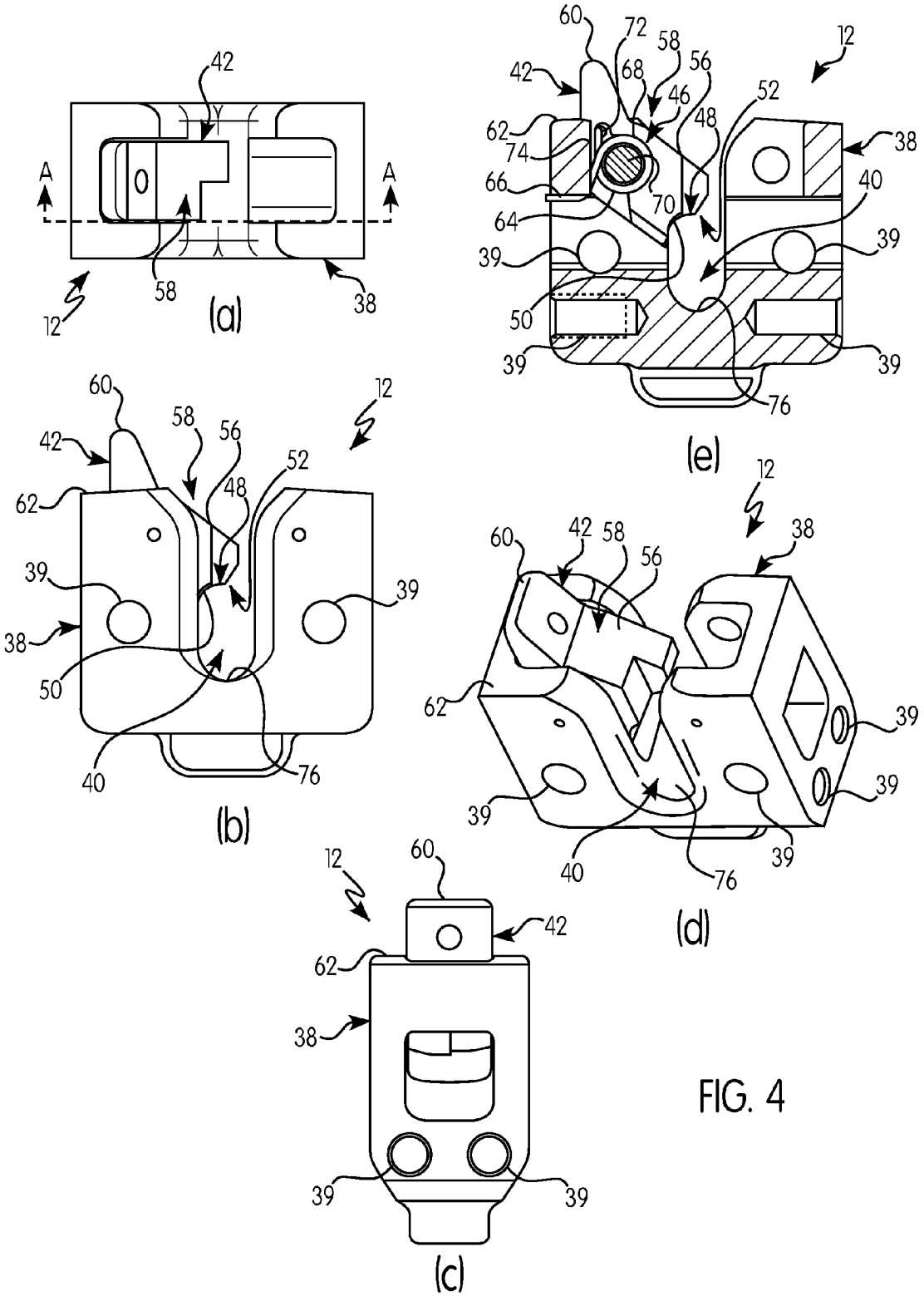
FIG. 4(*a*) is a top view of one embodiment of a user connection arrangement according to the principles of the present invention and in a closed position.
Figure 5:
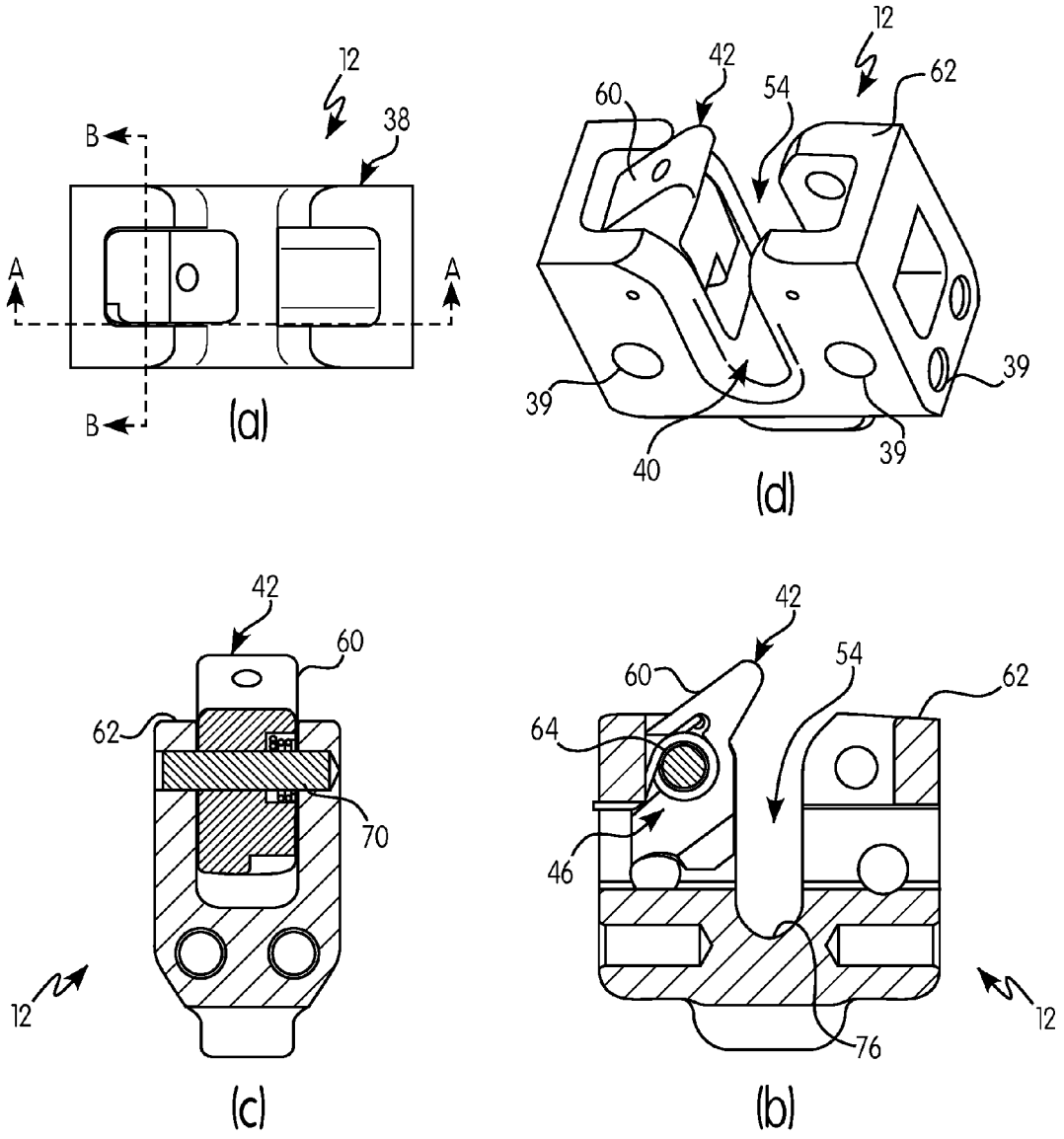
FIG. 5(*a*) is a top view of the user connection arrangement of FIG. 4 in an open position.

One preferred and non-limiting embodiment of a user connection arrangement 12 according to the present invention is illustrated in FIGS. 4 and 5. In particular, the user connection arrangement 12 of this embodiment includes a body 38, which is attachable to the frame 16 using known attachment techniques. The body 38, for example, can be attached to the frame 16 using known fixtures, such as screws, bolts, and the like, which may be inserted into attachment orifices 39, as illustrated in FIGS. 4 and 5. Any number or arrangement of such attachments can be used. For example, one such positioning and attachment arrangement of the user connection arrangement 12 with respect to the personal fall limiter arrangement 10 is illustrated in FIG. 1.

As best seen in FIGS. 4(*b*), 4(*d*), and 4(*e*), the body 38 includes or defines a recess 40,which is sized and shaped so as to receive a portion of the user connector A. In one aspect, the recess 40 may be U-shaped having an opening defined in a top surface of the body 38 and a bottom positioned adjacent a bottom surface of the body 38. In addition, the user connection arrangement 12 includes a tab 42 pivotally attached to the body 38. In addition, a biasing member 46 is engaged with the tab 42 and configured or adapted to urge the tab 42 towards a locked or closed position, which is the position illustrated in FIG. 4. Accordingly, in operation, the tab 42 is pivotal between this locked (or closed) position to prevent passage of the user connector A out of the recess 40, and an open position (as show in FIG. 5), which permits passage of a portion of the user connector A into or out of the recess 40.

While in the locked or closed position, at least a portion of a lower surface 48 of the tab 42 defines a bearing surface 50. This bearing surface 50 prevents removal of the user connector A from the recess 40, since, based upon the geometry of the tab 42 and relationship with the recess 40, in this locked or closed position, the user connector A bears against or contacts the bearing surface 50. This further facilitates maintaining the tab 42 in the locked or closed position (to which position the tab 42 is already being urged via the biasing member 46).

In order to remove the user connector A from the recess 40, a portion 52 of the lower surface 48 of the tab 42 is shaped. When the tab 42 is pivoted or moved to the open position (as illustrated in FIG. 5), the shaped portion 52 defines a passage 54 through which the user connector A can be removed from the recess 40. Once removed, the tab 42 moves back to the original, locked position. Specifically, the user connector A moves up through the passage 54 and, after contacting (and pushing), biasing, and/or user movement of the tab 42 back towards its closed position (with the user connector A above the lower portion of the tab 42), the user connector A can be removed from the user connection arrangement 12. Further, these movements can be defined from the point of view of the user connector A, i.e., the user connection arrangement 12 is moving with respect to the user connector A. Regardless, the functionality of the personal fall limiter arrangement 10 and user connection arrangement 12 is the same.

As best seen in FIGS. 4(*b*), 4(*d*), and 4(*e*), a portion 56 of an upper surface 58 of the tab 42 is sloped. This sloped surface or portion 56 assists in urging the tab 42 to the open position through contact with the user connector A, such as the curved portion C of the D-ring connector B. In particular, the user connector A is pushed against and slides down the sloped portion 56, thereby opening the tab 42, and forming the passage 54 through which the user connector A can be moved into the recess 40. See FIG. 5.

With further reference to FIGS. 4 and 5, the tab 42 includes an upper tab portion 60 that extends beyond an outer surface 62 of the body 38. In particular, this upper tab portion 60 is configured to be contacted by a user to pivot the tab 42 to the open position for removal of the user connector A. Therefore, the user pushes this upper tab portion 60 against the urging force of the biasing member 46 to move tab 42 to the opened position, such that the user connector A can be moved upward through the passage 54 and out of the recess 40.

The biasing member 46 may take a variety of forms and arrangements that facilitate urging the tab 42 to the locked or closed position. In the embodiment of FIG. 4, the biasing member 46 is a spring 64, which includes a first end 66 that extends into a portion of the body 38. Specifically, the spring 64 is positioned in a spring recess 68 that is sized and shaped so as to retain a portion of the spring 64 therein. This spring recess 68 is defined by a post 70 around which the spring 64 is coiled, with a second end 72 of the spring 64 urging against a wall 74 of the spring recess 68. This arrangement facilitates the urging or biasing of the tab 42 to the locked position. It should also be noted that the tab 42 is pivotally connected to the body 38 using the post 70 as the pivot axis.

Another feature of the user connection arrangement 12 of the present invention is directed to the urging of the user connector A (e.g., a curved portion C of the D-ring connector B, as illustrated in FIG. 11) away from a base 76 of the recess 40. In particular, this "urging" feature and function (which also may be referred to in the context of "resistance" or "bias") urges or biases the user connector A towards (or against) the bearing surface 50 of the tab 42. This "urging" function can be accomplished through the geometry of the recess 40. For example, in one preferred and non-limiting embodiment, and since the curved portion C of the D-ring connector B is rounded and tubular, the base 76 of the recess 40 is likewise rounded. Further, the base 76 is sized and shaped so as to urge or bias the user connector A (i.e., that portion of the user connector A in the recess 40) towards (and/or against) the bearing surface 50 of the tab 42. This further assists in keeping the tab 42 in the locked (or closed) position.

One functional result of such an arrangement requires the user to make an active motion with the user connector A in order to be able to actuate the tab 42 to the open position (to create the passage 54). In particular, the user must first push the user connector A towards the base 76 of the recess 40 before effectively pivoting the tab 42. This adds an additional safety feature that prevents accidental removal or detachment of the user connector A from the user connection arrangement 12, and personal fall limiter arrangement 10. It should be further noted that this urging force may be created through the geometry (as discussed above) of the recess 40 or, alternatively, through the use of some additional member or component positioned at or near the base 76 of the recess 40. For example, a spring, resilient surface or member, or other biasing or urging mechanism or arrangement can be used to accomplish this function.

Figure 6:
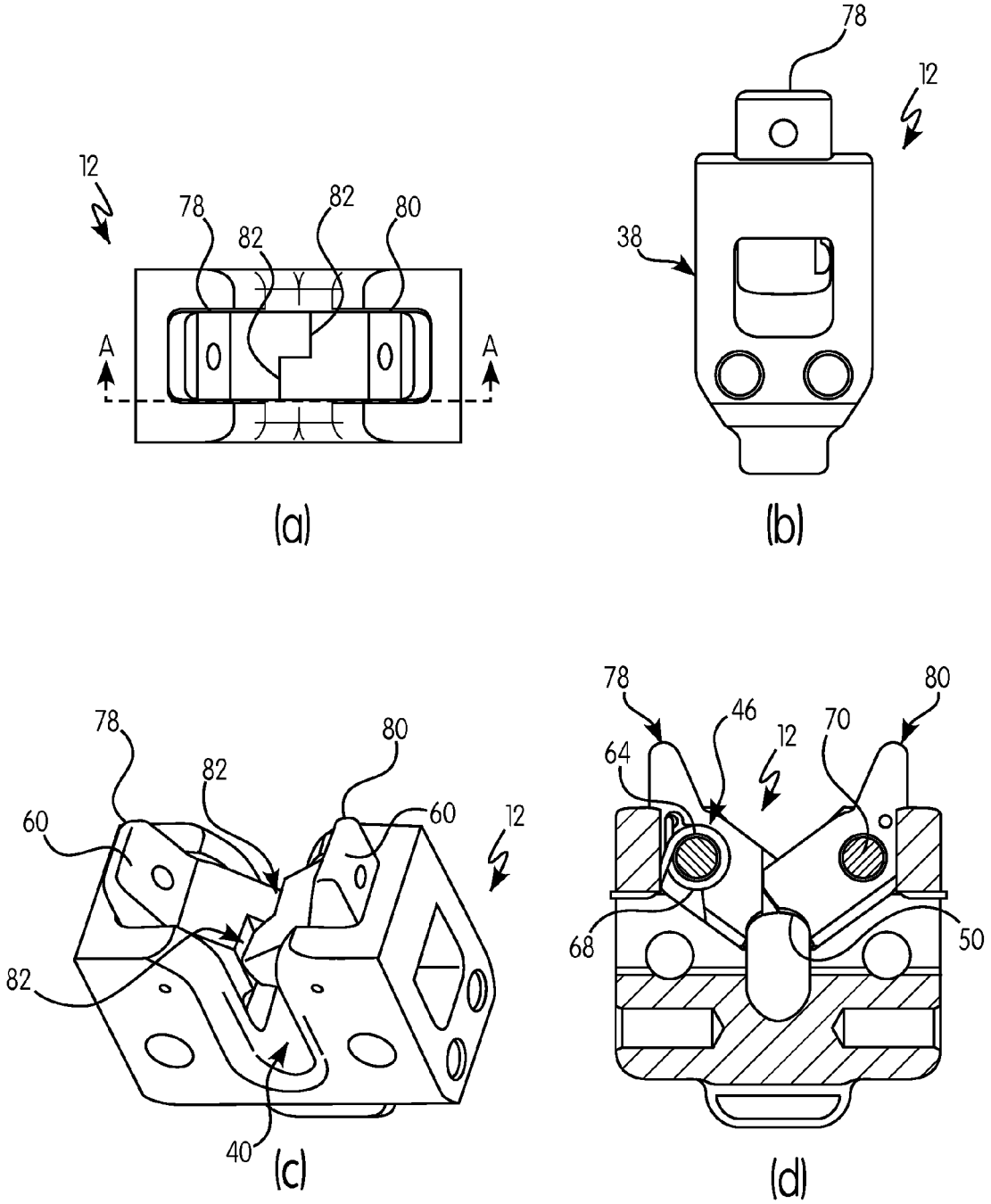
FIG. 6(*a*) is a top view of another embodiment of a user connection arrangement according to the principles of the present invention and in a closed position.
Figure 7:
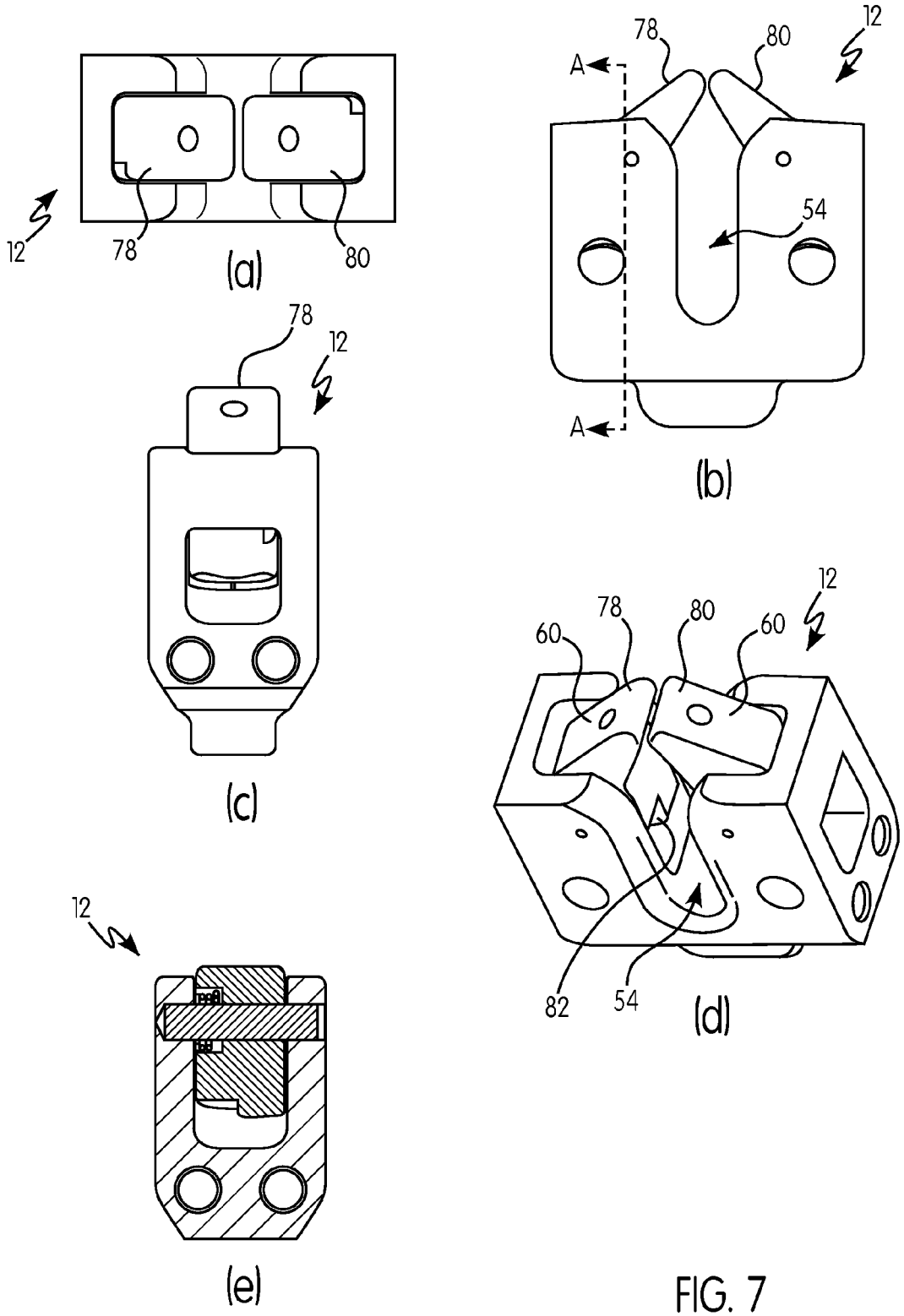
FIG. 7(*a*) is a top view of the user connection arrangement of FIG. 6 in an open position.

A further preferred and non-limiting embodiment of the user connection arrangement 12 of the present invention is illustrated in FIGS. 6 and 7. In particular, this embodiment includes two tabs 42, namely a first tab 78 and a second tab 80. It should be noted that the operation and movement of the first tab 78 and the second tab 80 are substantially similar to the operation and movement described above in connection with the single tab 42. Further, the remaining portions of the user connection arrangement 12, e.g., the body 38, the recess 40, the biasing member 46, and the like, are substantially similar in this embodiment to the above-described single-tab 42 embodiment. For example, as seen in FIG. 6(*d*), each of the first tab 78 and the second tab 80 include the spring 64, and therefore the spring recess 68 and post 70. Furthermore, the locked or closed position is identical, and creates the same bearing surface 50 for each of the tabs 78, 80. Still further, each tab 78, 80 includes the upper tab portion 60 for manipulation and actuation of the tab 78, 80.

In addition, the actuation of both tabs 78, 80 to the open position creates the passage 54, as illustrated in FIG. 7. As with the previous embodiment of FIGS. 4 and 5, it is this passage 54 through which the user connector A can be moved (or, dependent upon the viewpoint, the user connection arrangement 12 can be moved with respect to the user connector A). Regardless, and as with the previous single tab embodiment, the user connector A moves up through the passage 54 and, after contacting (and pushing), biasing, and/or user movement of the first tab 78 and second tab 80 back towards the closed position, the user connector A can be removed from the user connection arrangement 12. In particular, as the first tab 78 and second tab 80 are moved or urged back towards the closed position, the respective upper tab portions 60 are retracted and allow passage of the user connector A therethrough.

One primary difference between the embodiment of FIGS. 6 and 7 and the embodiment of FIGS. 4 and 5 is the additional redundancy feature in the geometry of the tabs 78, 80. In particular, by using a first tab 78 and a second tab 80, both tabs 78, 80 must be positively activated or actuated in order to create the passage 54 through which the user connector A can be removed from the recess 40, which is illustrated in FIG. 7. In addition, while only one tab 42 is required for effective operation and "locking" of the user connector A in the recess 40, the simultaneous use of a first tab 78 and a second tab 80 provides additional associated safety features, such as if one tab would somehow fail or be accidently actuated or pivoted during use or based upon contact in the environment in which the user is working.

With respect to the geometry, and when using a first tab 78 and a second tab 80, it is preferable that these tabs 78, 80 do not simply contact at an edge. Instead, an additional safety feature can be provided by including an indent 82 on each tab 78, 80. These indents 82 interlock and therefore extend adjacent to each other. This collinear arrangement allows the tabs 78, 80 to be effectively actuated or pivoted to create the passage 54, while, at the same time, ensure that both tabs 78, 80 can be locked (or closed) and, therefore, each provide a bearing surface 50 for capturing the user connector A in the recess 40.

Figure 8:
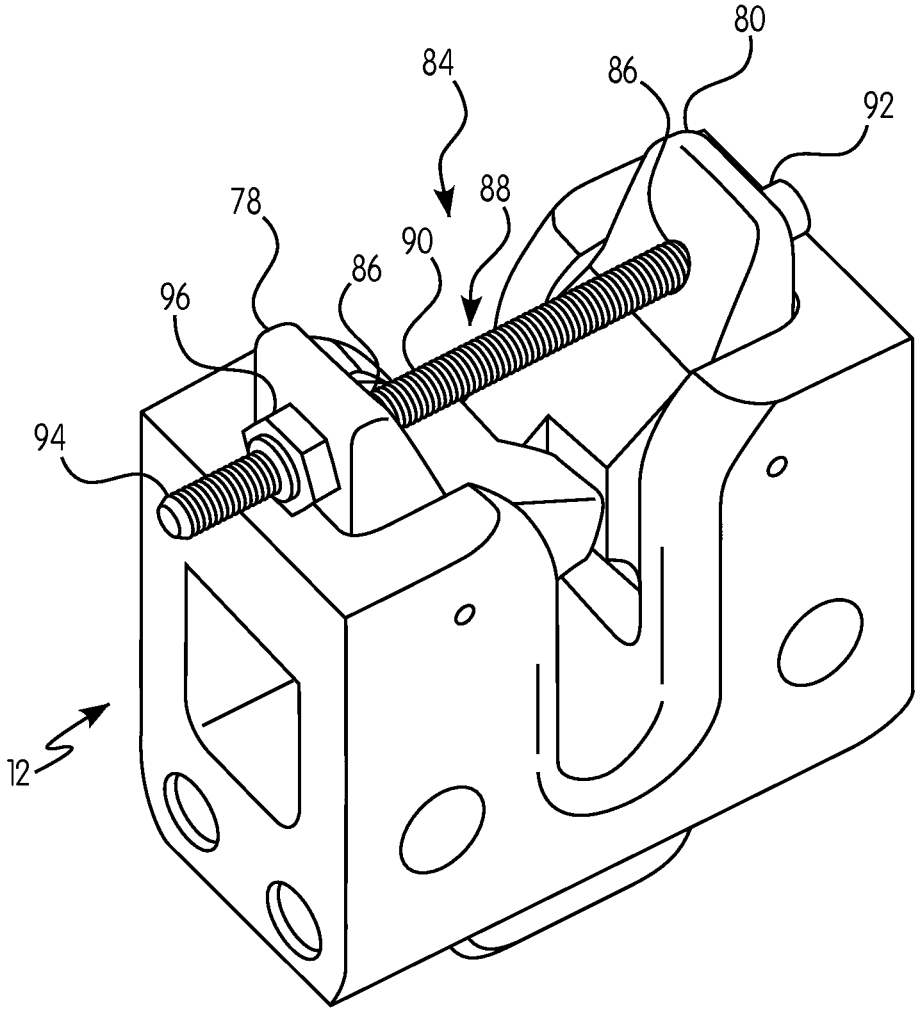
FIG. 8 is a perspective view of a further embodiment of a user connection arrangement according to the principles of the present invention.
Figure 9:
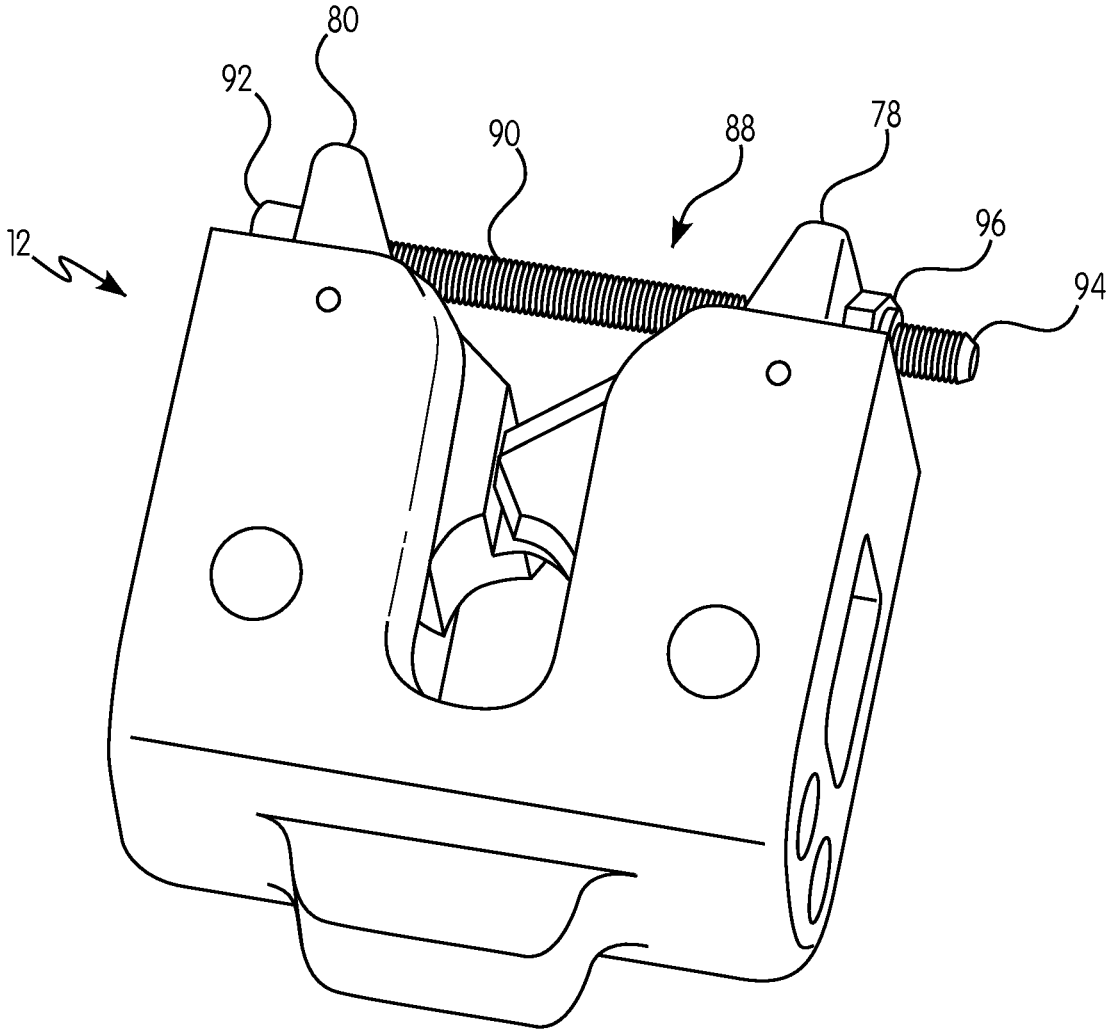
FIG. 9 is a further perspective view of the user connection arrangement of FIG. 8.

As illustrated in FIGS. 8 and 9, the user connection arrangement 12 (or personal fall limiter arrangement 10) may include an additional locking arrangement 84 to keep the tabs 78, 80 in the locked (or closed) position. This locking arrangement 84 may take a variety of forms, and in the preferred and non-limiting embodiment of FIGS. 8 and 9, the locking arrangement 84 (or some portion thereof) is removably positionable through a passage 86 that extends through each of the first tab 78 and the second tab 80. These passages 86 are aligned and preferably include a threaded inner surface.

As further seen in FIGS. 8 and 9, the locking arrangement 84 includes a bolt-and-nut assembly 88, which includes a threaded shaft 90 having a first end with a head portion 92. The head portion 92 is configured to bear against a surface of the second tab 80. With a free end 94 extending or threaded through the passage 86 of the first tab 78. A nut 96 is then threaded over the free end 94 of the shaft 90 and against a surface of the first tab 78. Accordingly, this locking arrangement 84 prevents accidental movement or actuation of the tabs 78, 80, and thereby provides still further safety benefits during operation.

As discussed above, the personal fall limiter arrangement 10 of the present invention can take a variety of forms, and the user connection arrangement 12 can be incorporated into, integrated with, or attached to the personal fall limiter arrangement 10 in various manners. As seen in FIG. 10, the personal fall limiter arrangement 10 includes a housing 98 that covers the majority of the components of the personal fall limiter arrangement 10, including the user connection arrangement 12. Of course, as discussed above, certain portions of the tabs 78, 80, such as the upper tab portion 60, are left exposed or extend from the housing 98 in order to allow actuation of the tabs 42.

The operation of this locking and unlocking motion is illustrated in FIG. 11 in connection with the embodiment (two-tab) of the user connection arrangement 12 of FIGS. 6 and 7. As seen in FIG. 11(*a*), the user connector A is in the form of the above-discussed D-ring connector B. As discussed, the D-ring connector B includes a curved portion C, as well as a substantial linear attachment portion D. Again, it is the curved portion C of the D-ring connector B that is removably positionable in the recess 40.

In FIG. 11(*a*), the D-ring connector B is moved towards the tabs 42, and contacts tabs 42 (as shown in FIG. 11(*b*)). This urges the tabs 42 towards the open position, such that the D-ring connector B, and specifically the curved portion C, can be slid into the recess 40. After the D-ring connector B has passed the tabs 42 and is seated in the recess 40, the tabs 42 are urged again to the locked (or closed) position via the biasing member 46. See FIG. 11(*c*). Accordingly, the tab 42 is continually urged towards the locked (or closed) position, so as to prevent removal during use of the personal fall limiter arrangement 10, and to further prevent accidental unlocking or opening of the tab 42.

In one preferred assembly process of the personal fall limiter arrangement 10 and the user connection arrangement 12 of the present invention, the loop 28 is created at one end of the line (or webbing), which can be used for some attachment or connection arrangement, such as a snap-hook, a carabiner, and the like. While not shown, another loop or similar arrangement can be formed at the first end 24 of the line 22 for connecting the line 22 to the hub 14 (or drum assembly). Next, and in the embodiment that includes a first hub 18 and a second hub 20, these hubs 18, 20 are directly or indirectly attached to a side plate (not shown), and the first end 24 of the line 22 is held in place by a central drum post or other component in the middle of each hub 18, 20. Next, the pawl-and-sperrad arrangement 34 is attached to each hub 18, 20, and this pawl-and-sperrad arrangement 34 may include pawls 36, a pawl plate, a pawl spring, and the like.

In assembling the user connection arrangement 12, the springs 64 are placed in respective spring recesses 68, and the tabs 42 are placed in the body and specifically over each post 70. As discussed, it is these posts 70 that facilitate the pivotal function of each tab 42, 78, 80, and these posts 70 are attached to, integrated with, or manufactured as part of the body 38. Once the user connection arrangement 12 is attached to or connected to the frame 16, the remaining portions of the braking assembly 32 are positioned and connected. Thereafter, the hubs 18, 20 (or "drum assembly") are positioned in the frame 16 and the line 22 of each hub 18, tensioned using the power spring 30 connected between each hub 18, 20 and the frame 16.

After these connections are made, the above-mentioned housing 98 is placed over these connected components, with the lines 22 extending from the housing 98. In this manner, the personal fall limiter arrangement 10 is assembled and ready for use, such as by attaching the user connector A to the user connection arrangement 12. As discussed above, this connection process is illustrated in FIG. 11 with relation to one preferred and non-limiting embodiment of the personal fall limiter arrangement 10 and user connection arrangement 12 of the present invention.

Accordingly, provided is a unique and functional personal fall limiter arrangement 10 and user connection arrangement 12. Again, while the user connection arrangement 12 has been discussed above in connection with a self-retracting lanyard arrangement, any personal fall limiter arrangement 10 can be used with the user connection arrangement 12. In addition, the user connection arrangement 12 facilitates the easy and safe attachment and detachment of the user connector A, such as the D-ring connector B.

It is further noted that in the illustrated embodiment, the user connection arrangement 12 is advantageously positioned between the first hub 18 and second hub 20 (or drum assemblies). This unique location provides the additional advantage that the load on the system takes place in the same plane, which reduces the load on the internal components of the personal fall limiter arrangement 10. Further, the structure, components, and interrelationships of and between the personal fall limiter arrangement 10 and user connection arrangement 12 of the present invention provide the additional safety benefits and features discussed above.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A personal fall limiter arrangement, comprising:

at least one hub rotatably attached to a frame;

at least one braking assembly configured to brake rotation of the at least one hub;

at least one line having a first end and a second end, the first end attached to a portion of the at least one hub, and the second end configured for attachment to a connector; and a user connection arrangement, comprising:

(i) a body attached to at least a portion of the frame and having a top surface, a bottom surface, and a U-shaped recess configured to receive at least a portion of a user connector, having an opening defined in the top surface of the body, and a bottom positioned adjacent the bottom surface of the body;

(ii) at least one tab pivotally attached to a first portion of the body; and (iii) biasing member engaged with the at least one tab and configured to urge the at least one tab from an open position towards a locked position;

wherein, in operation, the at least one tab is pivotal between: (1) the open position to permit passage of at least a portion of the user connector through the opening and into or out of the recess; and (2) the locked position to prevent passage of at least a portion of the user connector through the opening and out of the recess, wherein, in the locked position, at least a portion of a lower surface of the at least one tab defines a bearing surface preventing removal of the portion of the user connector from the recess, and wherein the a biasing member is positioned coaxial with respect to a rotational axis of the at least one tab.

2. The personal fall limiter arrangement of claim 1, wherein at least a portion of the lower surface of the at least one tab is shaped, such that the at least one tab is pivotal to remove the portion of the user connector from the recess.

3. The personal fall limiter arrangement of claim 1, wherein the at least one tab is pivotal to the open position, thereby forming a passage through which the portion of the user connector can pass.

4. The personal fall limiter arrangement of claim 1, wherein at least a portion of an upper surface of the at least one tab is sloped to facilitate urging the at least one tab to the open position.

5. The personal fall limiter arrangement of claim 1, wherein the at least one tab includes an upper tab portion extending beyond an outer surface of the body, wherein the upper tab portion is configured to be contacted by a user to pivot the at least one tab.

6. The personal fall limiter arrangement of claim 1, wherein the biasing member comprises a spring.

7. The personal fall limiter arrangement of claim 1, further comprising a locking arrangement configured to maintain the at least one tab in the locked position.

8. The personal fall limiter arrangement of claim 1, wherein the user connector comprises a D-ring connector having a curved portion and a substantially linear attachment portion, and wherein at least a portion of the curved portion of the D-ring connector is configured to be positioned in the recess.

9. The personal fall limiter arrangement of claim 1, wherein the recess is shaped so as to urge the user connector towards the at least one tab.

10. A personal fall limiter arrangement, comprising:

at least one hub rotatably attached to a frame;

at least one braking assembly configured to brake rotation of the at least one hub;

at least one line having a first end and a second end, the first end attached to a portion of the at least one hub, and the second end configured for attachment to a connector; and a user connection arrangement, comprising:

(i) a body rigidly attached to at least a portion of the frame and having a top surface, a bottom surface, and a U-shaped recess configured to receive at least a portion of a user connector, having an opening defined in the top surface of the body, and a bottom positioned adjacent the bottom surface of the body;

(ii) a first tab pivotally attached to a first portion of the body;

(iii) a first biasing member engaged with the first tab and configured to urge the first tab in a first direction from an open position towards a locked position;

(iv) a second tab pivotally attached to a second portion of the body in a mutually opposed position with respect to the first tab; and (v) a second biasing member engaged with the second tab and configured to urge the second tab from an open position towards a locked position;

wherein, in operation, the first tab and the second tab are pivotal between: (1) the open position to permit passage of at least a portion of the user connector through the opening and into or out of the recess; and (2) the locked position to prevent passage of at least a portion of the user connector through the opening and out of the recess, wherein, in the locked position, at least a portion of a lower surface of at least one of the first tab and the second tab defines a bearing surface preventing removal of the portion of the user connector from the recess, and wherein the first biasing member is positioned coaxial with respect to a rotational axis of the first tab, and the second biasing member is positioned coaxial with respect to a rotational axis of the second tab.

11. The personal fall limiter arrangement of claim 10, wherein the first tab includes a first protrusion, and the second tab includes a second protrusion, wherein the first protrusion extends substantially adjacent the second protrusion.

12. The personal fall limiter arrangement of claim 11, wherein at least a portion of the lower surface is shaped, such that the first tab, the second tab, or the first tab and the second tab is pivotal to remove the portion of the user connector from the recess.

13. The personal fall limiter arrangement of claim 10, wherein at least one of the first tab and the second tab is pivotal to the open position, thereby forming a passage through which the portion of the user connector can pass.

14. The personal fall limiter arrangement of claim 10, wherein at least a portion of an upper surface of at least one of the first tab and the second tab is sloped to facilitate urging the first tab, the second tab, or the first tab and the second tab to the open position.

15. The personal fall limiter arrangement of claim 10, wherein at least one of the first tab and the second tab includes an upper tab portion extending beyond an outer surface of the body, wherein the upper tab portion is configured to be contacted by a user to pivot the first tab, the second tab, or the first tab and the second tab.

16. The personal fall limiter arrangement of claim 10, wherein at least one of the first biasing member and the second biasing member comprises at least one spring.

17. The personal fall limiter arrangement of claim 10, further comprising a locking arrangement configured to maintain the first tab and the second tab in the locked position.

18. The personal fall limiter arrangement of claim 10, wherein the user connector comprises a D-ring connector having a curved portion and a substantially linear attachment portion, and wherein at least a portion of the curved portion of the D-ring connector is configured to be positioned in the recess.

19. The personal fall limiter arrangement of claim 10, wherein the recess is shaped so as to urge the user connector towards at least one of the first tab and the second tab.

* * * * *

UNITED STATES PATENT AND TRADEMARK OFFICE

CERTIFICATE OF CORRECTION

PATENT NO. : 9,238,156 B2
APPLICATION NO. : 13/223524
DATED : January 19, 2016
INVENTOR(S) : Robert Apel et al.

It is certified that error appears in the above-identified patent and that said Letters Patent is hereby corrected as shown below:

In the Claims

Column 10, Line 53, Claim 1, delete “biasing” and insert -- a biasing --

Column 10, Line 66, Claim 1, delete “the a” and insert -- the --

Column 12, Line 20, Claim 12, delete “claim 11,” and insert -- claim 10, --

Signed and Sealed this
Twenty-fourth Day of May, 2016

Michelle K. Lee

Michelle K. Lee
*Director of the United States Patent and Trademark Office*